United States Patent [19]

Lohest

[11] 4,221,344

[45] Sep. 9, 1980

[54] APPARATUS AND METHOD FOR CONTROLLING TEXTILE WINDER PACKAGE DRIVE MOTORS AND TRAVERSE DEVICE MOTORS

[75] Inventor: Hans Lohest, Remscheid-Lennep, Fed. Rep. of Germany

[73] Assignee: Barmag Barmer Maschinenfabrik Aktiengesellschaft, Remscheid-Lennep, Fed. Rep. of Germany

[21] Appl. No.: 20,220

[22] Filed: Mar. 14, 1979

[30] Foreign Application Priority Data

Mar. 15, 1978 [DE] Fed. Rep. of Germany ..... 2811158

[51] Int. Cl.[3] ..... B65H 54/38

[52] U.S. Cl. ..... 242/18.1

[58] Field of Search ..... 242/18.1, 18 DD, 43 R

[56] References Cited

U.S. PATENT DOCUMENTS

| | | | |
|---|---|---|---|
| 3,638,872 | 2/1972 | Jennings | 242/18.1 |
| 3,799,463 | 3/1974 | Peckinpaugh | 242/18.1 |
| 3,861,607 | 1/1975 | Schippers et al. | 242/18.1 X |
| 3,910,514 | 10/1975 | Hooper | 242/18.1 |
| 4,060,208 | 11/1977 | Raasch | 242/18.1 |

*Primary Examiner*—Stanley N. Gilreath

*Attorney, Agent, or Firm*—Bell, Seltzer, Park & Gibson

[57] ABSTRACT

An apparatus and method for jointly controlling textile winder package drive roll motors at constant speed and traverse device motors at varying speed, wherein at least a portion of the power generated during recurrent, e.g. periodic dynamic braking and deceleration by the traverse device motors is made available to drive the package drive roll motors. A single AC to DC converter supplies two DC to AC inverters, which in turn supply respectively the package roll drive motors and the traverse device motors, providing an interconnection permitting power feedback. Traverse motor speed varies in response to frequency changes induced by a varying control signal supplied from a signal generator to one inverter. The amount of motor-generated power fed back is optimized by adjusting the control signal amplitude and frequency, and as described more fully herein, means are provided for providing to both motor sets an appropriate voltage/frequency ratio.

14 Claims, 1 Drawing Figure

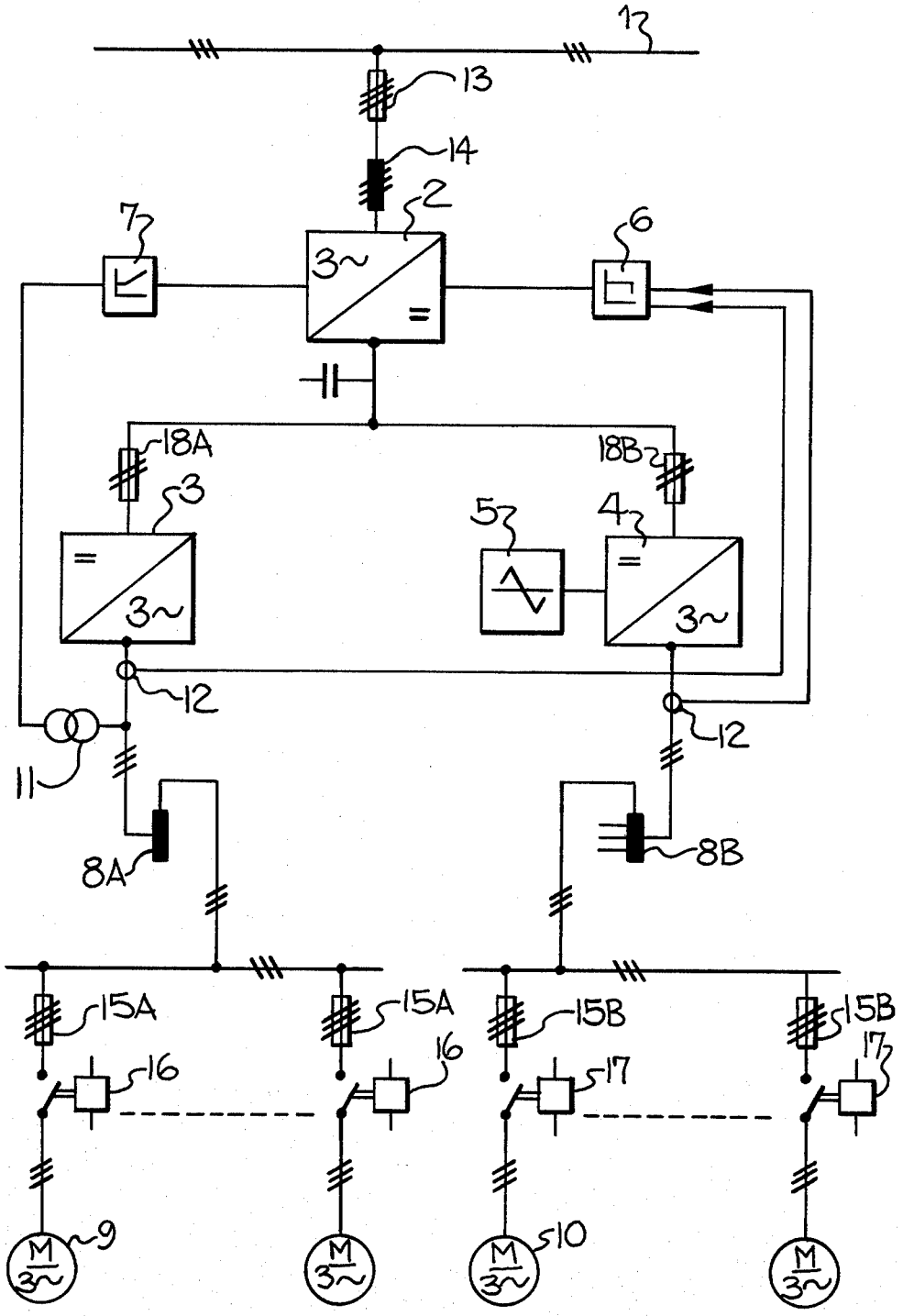
1
13
14
2
7
6
3~
=
18A
18B
3
5
4
=
3~
=
3~
12
12
11
8A
8B
15A
15A
15B
15B
16
16
17
17
9
10
M
3~

APPARATUS AND METHOD FOR CONTROLLING TEXTILE WINDER PACKAGE DRIVE MOTORS AND TRAVERSE DEVICE MOTORS

FIELD AND BACKGROUND OF THE INVENTION

High-speed textile yarn winders normally employ a synchronous motor to rotate a surface drive roller which in turn rotates a package core and applies incoming yarn thereabout. Such yarn is distributed axially along the rotating package core by a reciprocating traverse device, which is driven by a separate motor. One such winder is disclosed, for example, in Schippers et al U.S. Pat. No. 3,861,607,(+) which is, to the extent deemed necessary for full understanding of the present invention, hereby incorporated herein by reference.

(+) or Peckingpaugh U.S. Pat. No. 3,799,463

Each motor type normally receives alternating current from a separate frequency converter, consisting of an AC to DC converter and a DC to AC inverter. Completely separate frequency converters have been considered necessary because the surface drive roller requires constant speed, while the reciprocation rate of the traverse device is recurrently varied by, for example, up to five percent of average speed in order to avoid undesirable patterns in the yarn package as deposited on the core. Thus, one converter supplies a preset constant frequency, while the other supplies frequency which recurrently varies responsive to a control signal delivered to the converter. The traverse motor responds to this varying frequency by recurrently accelerating and decelerating between upper and lower speed limits. Further, the required average traverse motor speed and voltage/frequency ratio is often substantially different from that required by the package drive roll motor, although at times such values may be nearly the same.

During recurrent deceleration, the traverse device motors generate a back EMF. Heretofore, it has been the practice to disconnect the motor terminals from the converter during each deceleration interval and connect them to a power resistor, which dissipates the generated power as heat, and serves to dynamically brake the motor. Often, it has also been necessary to supply cooling in order to maintain the power resistor at a non-destructive temperature. Thus, this recurrently generated power is substantially wasted. Further, the converter supplying the traverse motors is made more complex and expensive by inclusion therein of the power resistor, the cooling device, and the switching network required to recurrently disconnect and reconnect the motor terminals.

SUMMARY OF THE INVENTION

With the above discussion in mind, it is an object of the present invention to increase operating efficiency by providing an apparatus and method for controlling textile winder package drive roll motors and traverse device motors which do not completely waste the power generated by the traverse device motors during recurrent dynamic braking. In realizing this object, an arrangement is provided wherein some of such power is used as part of the power supplied to the package drive roll motors. Such arrangement also serves to eliminate the previously-required power resistor, cooling device, and motor switching network, thus providing design and construction savings as well.

A further object of the present invention is to provide still further design and construction savings by eliminating the necessity for completely separate frequency converters for each type of motor. In realizing this object, an arrangement is provided wherein both motor types are jointly controlled via a single AC to DC converter supplying power to separate DC to AC inverters, while maintaining the capability of supplying each motor type with different frequency levels and voltage/frequency ratios without undue inter-motor cross influence.

BRIEF DESCRIPTION OF THE DRAWING

Some of the objects of the invention having been stated, other objects and advantages will appear as the description proceeds, when taken in connection with the accompanying drawing, which is a schematic diagram of a joint control circuit arrangement accomplishing the objects of the invention.

DETAILED DESCRIPTION OF THE INVENTION

While the present invention will be described hereinafter with more particularity, and with particular reference to the accompanying drawing in which a preferred embodiment for the invention is shown, it is to be understood at the outset of the description which follows that the present invention is contemplated as being subject to modification by persons skilled in the applicable arts once an understanding of the present invention has been gained. Accordingly, the detailed description and accompanying drawing are to be understood broadly as directed to teaching persons skilled in the art the general utility of the present invention, and not as limiting the scope of the invention.

Briefly stated, the arrangement provided includes first and second supply means for supplying variable frequency alternating current, respectively, to one or more package drive motors and one or more traverse device motors. Each such supply means may be a solid state DC to AC inverter of any known circuit configuration, so long as the inverter supplying the traverse device motors is capable of transmitting power in both directions. The traverse motors are accelerated and decelerated by a current of varying frequency supplied by the second inverter, which is responsive to a control signal of adjustable frequency and amplitude. Means interconnecting the aforesaid supply means are also provided, in the form of a single AC to DC converter supplying both inverters, whereby at least a portion of the power generated by the traverse motors during dynamic braking can be delivered to the package drive motors. This single AC to DC converter need not be quite as large in capacity as the total capacity required if two separate converters were used, due to efficiencies inherent in the fact that the output currents of the two inverters are of differing frequency, phase and voltage relationships.

Referring more specifically to the accompanying drawing, it should first be noted that the symbol used thereon to denote that three-phase power is being conducted from one point to another consists of a group of three short slanted lines intersecting the single line connecting the points. It should be further understood that only components pertinent to the invention are shown on said drawing, and that, for example, apparatus for starting the motors or for coupling the motors to the winder is not shown, but may be any conventional means.

In the circuit shown, a single AC to DC converter 2 draws power from an AC line 1 via an overload protector 13 and a choke 14, and supplies direct current via overload protectors 18A and 18B to a first variable frequency DC to AC inverter 3 and to a second variable frequency DC to AC inverter 4. The first inverter 3 supplies alternating current of a predetermined constant frequency to a set of one or more package drive roll motors 9 via a transformer 8A, overload protectors 15A, and contactors 16. Motors 9 operate at constant speed dependent upon the frequency supplied, and are normally synchronous motors but may also be asynchronous motors.

The second inverter 4 supplies alternating current to a set of one or more traverse device motors 10, via a transformer 8B having several taps, overload protectors 15B, and contactors 17. The frequency of the supplied current varies responsive to a repeatedly, e.g. periodically varying signal supplied to the second inverter 4 by an adjustable signal generator 5. In turn, traverse motors 10 accelerate and decelerate, e.g. periodically, in accordance with the supplied frequency, and may be either synchronous or asynchronous motors.

In operation, traverse device motors 10 act as generators during recurrent deceleration. A portion of the power thus generated is fed back via the second inverter 4 to the first inverter 3, and thence to package drive roll motors 9. The remainder of the generated power is dissipated at various points in the circuit, as the traverse motors are dynamically braked during recurrent deceleration by the reflected circuit impedance appearing at their terminals. It has been determined that the amount of generated power made available to package drive motors 9 during deceleration is a function of the amplitude and frequency of the control signal delivered to the second inverter 4 by the signal generator 5, as well as a function of the average frequency level supplied to the traverse motors 10. When the product of the control signal frequency in cycles per minute and the amplitude of the resultant variation in output frequency from the corresponding inverter 4, expressed as a percentage of average output frequency, exceeds ten, the amount of fed back power actually available to motors 9 is optimum and is equal to about one-third of the total power generated by the traverse motors 10. As average traverse speed increases, the amount of such power increases.

Referring again to the drawing, current sensors 12 detect the magnitude of the output current from each of the inverters 3 and 4, and transmit a signal to an adjustable control device 6, which in turn causes the AC to DC converter 2 to supply reduced output voltage when either such current exceeds predetermined limits. Further, the frequency sensor 11 detects the frequency of the output current from the first inverter 3, and transmits a signal to a function generator 7, which in turn causes the AC to DC converter 2 to alter the supplied output voltage. When suitably adjusted, these detector-feedback portions of the arrangement permit the traverse motors and the package drive motors to receive current at frequency levels which may differ considerably, while maintaining in each instance voltage/frequency ratios appropriate to motor requirements.

Voltage/frequency ratio can also be advantageously affected by the optional inclusion and suitable selection of either or both of matching transformers 8A and 8B. Such transformers further serve to aid in isolating one set of motors from the other, so as to minimize intermotor cross influence. Such isolation is particularly desirable during periodic acceleration of traverse device motors 10 in the case when the average second inverter 4 frequency is close to the first inverter 3 frequency. Traverse reciprocation oscillation could be adversely affected if the traverse motors tended to respond to the inverter 3 frequency rather than to track the inverter 4 frequency variations. Such isolation can be further enhanced by selecting as traverse motors 10 suitably structured induction motors rather than synchronous motors. More particularly, when such motors are constructed using bundles of iron laminations of a material and configuration adapted to remain unsaturated magnetically during normal operation, the speed of such motors will more readily track variations in supply current frequency.

As used in this description, the term "periodic" is to be understood broadly as referring to variation about an average value over an interval of time and is not to be deemed as restrictive to any specific wave form or patterns.

In the drawings and specification, there has been set forth a preferred embodiment of the invention, and although specific terms are employed, they are used in a generic and descriptive sense only and not for purposes of limitation, the scope of the invention being defined in the claims.

That which is claimed is:

1. In a textile strand winder having package drive motors and traverse device motors, apparatus for jointly controlling the motors and comprising:

first means for supplying variable frequency alternating current electrical power to a set of package drive motors;

second means for supplying variable frequency alternating current electrical power to a set of traverse device motors;

signal means coupled to said second supply means for varying the frequency of the current supplied by said second supply means to said traverse device motors for thereby alternately accelerating and dynamically braking said motors; and means interconnecting said first and second supply means for delivering to said package drive motors at least a portion of the electrical power available from said traverse device motors due to generation of back electromotive force during recurrent braking whereby total power drawn by the winder is reduced and operating efficiency facilitated.

2. A winder according to claim 1, wherein said signal means comprises means for adjusting the amplitude and frequency of the variations in the current supplied by said second supply means for pattern breaking on the bobbins to be wound.

3. In a textile strand winder having package drive motors and traverse device motors, apparatus for jointly controlling the motors and comprising:

first inverter means for supplying variable frequency alternating current electrical power to at least one package drive motor;

second inverter means for supplying variable frequency alternating current electrical power to at least one traverse device motor;

modulating means coupled to said second inverter means for recurrently increasing and decreasing the frequency of the current supplied by said second inverter means to the traverse device motor and for thereby accelerating and decelerating the traverse device motor in accordance with a predetermined pattern; and direct current supply means interconnecting said first and second inverter means for delivering direct current to both said inverter means and for feeding back to the package drive motor through said first inverter at least a portion of the electrical power generated by the traverse device motor during said recurrent deceleration.

4. A winder according to one of claims 1, 2 and 3, further comprising means interposed between at least one of said means for supplying alternating current and said motors for maintaining the voltage/frequency ratio of the alternating current supplied by said supply means at levels appropriate to motor load requirements.

5. A winder according to claim 3, further comprising means for sensing the frequency of the currents supplied by said inverters, and further wherein said direct current supply means comprises means responsive to said sensing means for controlling the voltage/frequency ratio of the alternating currents supplied by said inverters by varying the direct current supplied to said inverters.

6. A winder according to one of claims 1 and 3 wherein the package drive motors are synchronous motors and the traverse device motors are asynchronous motors, said motors cooperating for minimizing any otherwise adverse effect the output current frequency of said first inverter might have upon the operation of said traverse device motors.

7. A method of operating a textile strand winder while jointly controlling package drive motors and traverse device motors thereof and comprising:

coupling a set of package drive motors to one of two interconnected sources of variable frequency alternating current electrical power; and coupling a set of traverse device motors to the other of the two interconnected sources of variable frequency alternating current electrical power; while increasing and decreasing the frequency of the alternating current supplied to the set of traverse device motors by the other source for thereby alternately accelerating and dynamically braking the traverse device motors; and delivering through the one source to the set of package drive motors at least a portion of the power generated by the set of traverse device motors during recurrent braking thereof whereby the total power drawn by the winder is reduced and the efficiency thereof is improved.

8. A method as claimed in claim 7, wherein the step of increasing and decreasing the frequency comprises controlling the amount of power supplied by the traverse device motor to the package motor by adjusting the amplitude and frequency of acceleration and braking.

9. A method of operating a textile strand winder while controlling both package drive and traverse device motors thereof and comprising:

supplying variable frequency alternating current electrical power to at least one package drive motor from a first source thereof; while supplying variable frequency alternating current electrical power to at least one traverse device motor from a second source thereof; while increasing and decreasing the frequency of the current supplied to the traverse device motor from said second source for thereby alternately accelerating and decelerating the traverse device motor; and supplying at least a portion of the power available from the traverse device motor during recurrent deceleration to the package drive motor.

10. A method as claimed in claim 9, wherein the step of increasing and decreasing the frequency comprises adjusting the amplitude and frequency of said acceleration and deceleration for maximizing the power supplied by said traverse device motor to said package drive motor.

11. A method as claimed in one of claims 7 through 10 further comprising the step of maintaining the voltage/frequency ratio of the power supplied to each motor at levels appropriate to motor load requirements.

12. A method for jointly controlling package drive motors and traverse device motors of a textile strand winder comprising:

supplying direct current electrical power from a single source to both a first variable frequency inverter and a second variable frequency inverter; while coupling the first inverter to a set of package drive motors; and coupling the second inverter to a set of traverse device motors; then varying the frequency of the current supplied to the set of traverse device motors by the second inverter by supplying to the second inverter a signal effective to modulate the frequency of said current for thereby accelerating and decelerating the traverse device motors; while delivering to the set of package drive motors at least a portion of power generated by the set of traverse device motors during recurrent deceleration; and adjusting the frequency and amplitude of said modulating signal for pattern breaking on the bobbin.

13. A winder according to claim 6, wherein the asynchronous traverse motors include bundles of iron laminations so configured as to remain magnetically unsaturated during normal operation.

14. A winder according to claim 3, further comprising means coupled to said modulating means for adjusting the amplitude and frequency of said acceleration and deceleration so as to control the portion of the power fed back from the traverse motor to the package drive motor.

* * * * *